United States Patent [19]

Moore

[11] 4,390,066

[45] Jun. 28, 1983

[54] WELL LOCATION PATTERN FOR SECONDARY AND TERTIARY RECOVERY

[75] Inventor: J. Scott Moore, Ponca City, Okla.

[73] Assignee: Conoco Inc., Ponca City, Okla.

[21] Appl. No.: 231,814

[22] Filed: Feb. 5, 1981

[51] Int. Cl.[3] ..... E21B 43/30

[52] U.S. Cl. ..... 166/245; 166/268

[58] Field of Search ..... 166/245, 268

[56] References Cited

U.S. PATENT DOCUMENTS

| | | | |
|---|---|---|---|
| 2,880,803 | 4/1959 | Parker | 166/245 |
| 2,914,309 | 11/1959 | Salomonsson | 166/245 |
| 2,923,535 | 2/1960 | Ljungstrom | 166/245 X |
| 3,126,953 | 3/1964 | Nelson et al. | 166/245 |
| 3,167,117 | 1/1965 | Santourian | 166/245 |
| 3,209,825 | 10/1965 | Alexander et al. | 166/245 |
| 3,380,523 | 6/1966 | Hoyt et al. | 166/245 |
| 3,386,504 | 12/1965 | Kunetka | 166/245 |
| 3,402,768 | 9/1968 | Felsenthal et al. | 166/245 |
| 3,441,082 | 11/1967 | Fitzgerald | 166/245 |
| 3,805,892 | 12/1972 | Haynes, Jr. | 166/245 |
| 4,082,358 | 2/1976 | Learmont | 299/4 |

*Primary Examiner*—Stephen J. Novosad
*Assistant Examiner*—George A. Suchfield
*Attorney, Agent, or Firm*—A. Joe Reinert

[57] ABSTRACT

A method of producing hydrocarbons from a subterranean formation comprising penetrating the formation with a plurality of wells arranged in a pattern defining a series of regular pentagons with a well at the center of each pentagon, injecting a fluid into the formation by way of the wells at the centers of the pentagons whereby hydrocarbons contained in the formation are displaced from the center wells towards the wells defining the pentagons and producing the hydrocarbons by way of the wells defining the pentagons.

6 Claims, 5 Drawing Figures

INJECTION WELLS
PRODUCTION WELLS

INJECTION WELLS
PRODUCTION WELLS

INJECTION WELLS
PRODUCTION WELLS

INJECTION WELLS
PRODUCTION WELLS

INJECTION WELLS
PRODUCTION WELLS

WELL LOCATION PATTERN FOR SECONDARY AND TERTIARY RECOVERY

BACKGROUND OF THE INVENTION

1. Field of the Invention

The present invention relates to methods of producing hydrocarbons from a subterranean formation using improved well location patterns, and more particularly, but not by way of limitation, to improved inverted six-spot well patterns for secondary and tertiary recovery procedures carried out in subterranean formations.

2. Description of the Prior Art

In producing subterranean hydrocarbon-containing formations through a plurality of wells, it is a general practice to produce one or more production wells in the formation until production therefrom is depleted, whereupon the depleted wells are shut down and production is continued via other production wells in the formation. When the production from all of the production wells in the formation has been depleted, secondary and tertiary recovery operations are carried out to recover hydrocarbons remaining therein.

In planning the drilling of production wells in a field for subsequently carrying out secondary and/or tertiary recovery operations, e.g., gas repressuring and/or water, fire, steam and solvent flooding, well patterns that are geometrically repeatable have been utilized. When the secondary and/or tertiary recovery operations are commenced, fluid is injected into some of the wells to displace hydrocarbons in the subterranean formation to others of the wells. The front or interface between the injection fluid and hydrocarbon fluids in the formation moves from the injection wells toward the production wells, changing shape as it progresses. Due to the lower pressure around the production wells, a portion of the interface tends to accelerate and cusp into the production wells. Breakthrough of the injected fluid occurs when the interface reaches the production wells.

The most commonly heretofore used well pattern for carrying out hydrocarbon recovery operations is a series of five-spot sub-patterns each having four injection wells at the corners of a square and a production well at the center. Inverted five-spot sub-patterns have also been used having an injection well at the center and production wells at the corners. In a series of five-spot sub-patterns, there are as many injection wells as production wells.

Other basic well sub-patterns which have been used are the inverted seven-spot, and the inverted nine-spot. The term "inverted" is used to designate that the injection well is at the center of the sub-pattern with production wells defining the sub-pattern. In some instances the use of a series of inverted five-spot sub-patterns does not provide an adequate number of producing wells surrounding the injection wells, and the use of a series of seven-spot sub-patterns requires the drilling of too many wells which have become much more expensive to drill in recent years.

By the present invention an improved well pattern is provided having a greater number of producing wells surrounding the injection wells than a series of five-spot sub-patterns and requiring fewer wells than a series of seven-spot sub-patterns.

SUMMARY OF THE INVENTION

A method of producing hydrocarbons from a subterranean formation comprising penetrating the formation with a plurality of wells arranged in a pattern defining a series of regular pentagons with a well at the center of each pentagon; injecting a fluid into the formation by way of the wells at the centers of the pentagons whereby hydrocarbons contained in the formation are displaced from the center wells toward the wells defining the pentagons; and producing the hydrocarbons by way of the wells defining the pentagons.

It is, therefore, a general object of the present invention to provide an improved well pattern for carrying out secondary and tertiary recovery operations.

A further object of the present invention is the provision of methods of producing hydrocarbons from a subterranean formation using a well pattern comprised of a series of inverted six-spot sub-patterns having more producing wells surrounding injection wells than a series of inverted five-spot sub-patterns but requiring fewer wells than a series of inverted seven-spot sub-patterns.

Other and further objects, features and advantages of the invention will be readily apparent to those skilled in the art upon a reading of the description of preferred embodiments which follows when taken in conjunction with the accompanying drawing.

DESCRIPTION OF PREFERRED EMBODIMENTS

Figure 1:
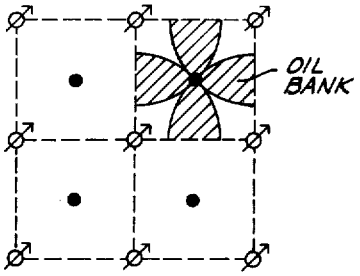
FIG. 1 (PRIOR ART)
FIG. 1 illustrates a prior art well pattern comprised of a series of five-spot sub-patterns in a formation undergoing secondary recovery and illustrates the interface of the injected fluid with the oil bank in the formation at breakthrough at the production wells of one of the sub-patterns.
Figure 2:
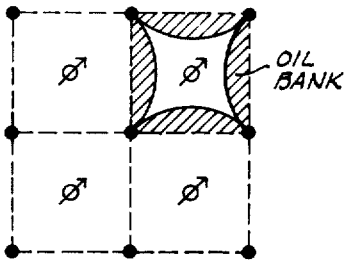
FIG. 2 (PRIOR ART)
FIG. 2 is similar to FIG. 1, but illustrates an inverted five-spot pattern.
Figure 3:
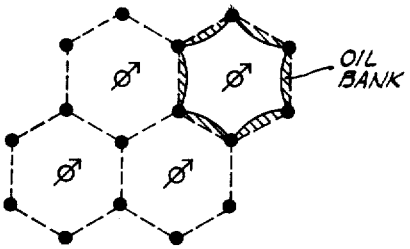
FIG. 3 (PRIOR ART)
FIG. 3 is similar to FIG. 1, but illustrates an inverted seven-spot pattern.

The well location patterns illustrated in FIGS. 1 through 3 are prior art well location patterns which have been used in secondary and tertiary recovery operations. In FIG. 1 a conventional pattern formed of a series of five-spot sub-patterns is illustrated. That is, each of the five-spot sub-patterns includes five wells, four injection wells positioned at the corners of a square with a production well positioned at the center of the square. In this configuration, the oil bank remaining in the formation for each five-spot sub-pattern is as shown in FIG. 1. That is, at breakthrough, the interface between the oil bank and the injected fluid cusps into the central production well at points opposite the injection wells.

IN FIG. 2, a prior art well pattern comprised of a series of inverted five-spot sub-patterns is illustrated. In this configuration, the wells at the corners of each square are production wells and a single injection well is centrally positioned in the square. At breakthrough the interface between the injected fluid and the oil bank cusps into each production well as illustrated. As will be understood, in a series of five-spot sub-patterns, both conventional and inverted five-spot sub-patterns are present.

In FIG. 3 a prior art well pattern comprised of a series of inverted seven-spot sub-patterns is illustrated. In this configuration, the production wells in each sub-pattern define regular hexagons and the injection wells are positioned at the center of each hexagon. In this pattern, more producing wells surround each injection well as compared to a series of five-spot sub-patterns and at breakthrough the interface between the injected fluid and the oil bank cusps into each production well as illustrated.

As stated above, in some fields, a well pattern comprised of a series of five-spot sub-patterns does not provide adequate producing wells surrounding the injection wells and because the drilling of wells into subterranean formations has become much more costly in recent years, the use of a well pattern comprised of a series of seven-spot sub-patterns is too costly. In these instances, the methods of the present invention are particularly suitable wherein a well pattern comprised of a series of inverted six-spot sub-patterns is utilized. The series of inverted six-spot sub-patterns can be arranged in two basic ways depending upon various factors such as the viscosity of the hydrocarbons being produced, anomalies in the subterranean formation, etc., as shown in FIGS. 4 and 5.

Figure 4:
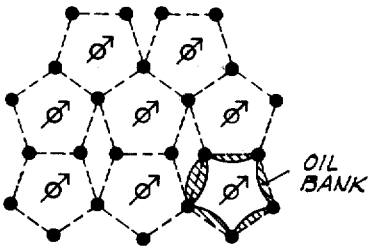
FIG. 4 illustrates one form of a well location pattern of the present invention using inverted six-spot sub-patterns and illustrates the interface of the injected fluid with the oil bank at breakthrough at the production wells of one of the sub-patterns.

In FIG. 4, the inverted six-spot sub-patterns are positioned whereby the production wells defining the regular pentagons of the pattern also define diamond shapes between adjacent pairs of the pentagons. Injection wells are located centrally within the production wells defining the pentagons. While the interior diamond shaped areas defined by the production wells of the pattern do not have injection wells positioned therein, depending upon the properties of the hydrocarbons being recovered and the ability of the injected fluid to sweep into the diamond shaped areas, adequate recovery of hydrocarbons from the subterranean formation being produced including the diamond shaped area can result. As mentioned above, the advantage of the pattern is that it provides more producing wells surrounding injection wells than a pattern comprised of a series of five-spot sub-patterns and requires the drilling of fewer wells than a pattern comprised of a series of inverted seven-spot sub-patterns.

Figure 5:
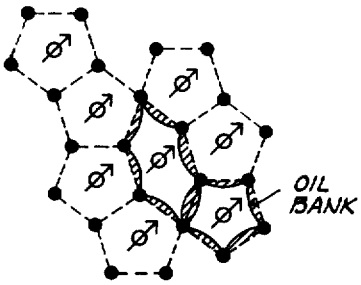
FIG. 5 is similar to FIG. 4, but illustrates an alternate form of the well location pattern of the present invention.

In other applications where it is undesirable to utilize the series of inverted six-spot sub-patterns wherein the diamond shaped interior areas of the pattern are left without injection wells, the alternate form of the well location pattern of this invention illustrated in FIG. 5 is utilized. In this form, the production wells defining regular pentagons are positioned whereby the production wells also define at least one hexagonal shape interiorly of the pattern and an injection well is positioned at the center of the hexagon. This pattern is the most preferred in that it achieves a high sweep efficiency of the entire formation being produced and more importantly, provides more producing wells surrounding injection wells than a pattern utilizing five-spot sub-patterns with fewer wells than required by a pattern comprised of inverted seven-spot sub-patterns.

In carrying out this method of the present invention utilizing the patterns illustrated in FIGS. 4 and 5, a fluid is injected into the subterranean formation by way of the injection wells whereby hydrocarbons contained in the formation are driven towards the production wells. In order to facilitate a clear understanding of the methods of the present invention and the advantages thereof over prior art methods, the following Example is given.

EXAMPLE

For a 1000 acre field, the total number of wells required using prior art well patterns comprised of series of five-spot and seven-spot sub-patterns as well as the alternate forms of the well patterns of the present invention comprised of series of six-spot sub-patterns are given in Table I below based on a distance of 330 feet between injection wells and producing wells in each five-spot, six-spot or seven-spot sub-pattern. The numbers of repeating patterns in each well pattern are also shown in Table I. The repeating patterns in the prior art well patterns using series of five-spot and seven-spot sub-patterns are the five-spot and seven-spot sub-patterns. The repeating patterns for the well patterns of the present invention are two six-spot sub-patterns and a seven-spot hexagonal sub-pattern for the six-spot series with hexagonal center well pattern and two six-spot sub-patterns and a four-spot diamond sub-pattern for the six-spot series with diamond center well pattern. As shown in Table I, the well patterns of the present invention require fewer wells as compared to the prior art seven-spot well patterns.

TABLE I

| Well Pattern | Number of Repeated Patterns | Total Number of Wells |
|---|---|---|
| 5-Spot Series | 200 | 400 |
| 6-Spot Series With Hexagonal Center | 52.0 | 416 |
| 6-Spot Series With Diamond Center | 71.8 | 431 |
| 7-Spot Series | 154.7 | 469 |

For the same 1000 acre field and 330 foot injection well to production well distance, the numbers of injection and production wells devoted to each repeating pattern, the production well to injection well ratio for each repeating pattern and the area of each repeating pattern is given in Table II below.

TABLE II

| | Number of Complete Wells In Repeating Pattern | | Production To Injection Well | Area of Repeating Patterns | |
|---|---|---|---|---|---|
| Well Pattern | Production | Injection | Ratio | Ft. | Acres |
| 5-Spot Series | 1 | 1 | 1 | 217,800 | 5.0 |
| 6-Spot Series With Hexagonal Center | 5 | 3 | 1.67 | 837,899 | 19.2 |
| 6-Spot Series With Diamond Center | 4 | 2 | 2 | 606,930 | 13.9 |
| 7-Spot Series | 2 | 1 | 2 | 282,930 | 6.5 |

Thus, the present invention is well adapted to carry out the objects and attain the advantages mentioned as well as those inherent therein. While numerous changes can be made by those skilled in the art, such changes are encompassed within the spirit of this invention as defined by the appended claims.

I claim:

1. A method of producing hydrocarbons from a subterranean formation comprising:

penetrating said formation with a plurality of wells arranged in a pattern defining a series of replicating regular pentagons with an injection well at the center of each pentagon and production wells at the corners of each pentagon;

injecting a fluid into said formation by way of the injection wells whereby hydrocarbons contained in said formation are displaced from the injection wells toward the production wells in said pattern; and producing said hydrocarbons by way of said production wells.

2. The method of claim 1 wherein said wells are arranged in said pattern whereby said wells defining said pentagons also define diamond shapes between adjacent pairs of said pentagons.

3. The method of claim 1 wherein said wells are arranged in said pattern whereby said wells defining said pentagons also define at least one hexagonal shape with a well at the center thereof surrounded by said pentagons and said fluid is also injected into said formation by way of said well at the center of said hexagonal shape.

4. In a method of producing hydrocarbons from a subterranean formation wherein said formation is penetrated by a plurality of wells and fluid is injected into said formation by way of some of said wells to drive hydrocarbons therefrom towards other of said wells from which said hydrocarbons are produced, the improvement comprising:

arranging said wells penetrating said formation in a pattern defining a series of replicating regular pentagons with a well at the center of each of said pentagons; and injecting said fluid into said formation by way of said wells at the centers of said pentagons.

5. The method of claim 4 wherein said wells are arranged in said pattern whereby said wells defining said pentagons also define diamond shapes between adjacent pairs of said pentagons.

6. The method of claim 4 wherein said wells are arranged in said pattern whereby said wells defining said pentagons also define at least one hexagonal shape with a well at the center thereof surrounded by said pentagons and said fluid is also injected into said formation by way of said well at the center of said hexagonal shape.

* * * * *